US006428279B1

(12) United States Patent
Reluzco et al.

(10) Patent No.: US 6,428,279 B1
(45) Date of Patent: Aug. 6, 2002

(54) LOW WINDAGE LOSS, LIGHT WEIGHT CLOSURE BUCKET DESIGN AND RELATED METHOD

(75) Inventors: George Ernest Reluzco, Schenectady; David Alan Caruso, Ballston Lake; Douglas Carl Colwell, Schenectady; James Rollins Maughan, Scotia, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/742,284

(22) Filed: Dec. 22, 2000

(51) Int. Cl.[7] ..... F01D 5/30
(52) U.S. Cl. ..... 416/215; 416/222
(58) Field of Search ..... 415/173.7; 416/215, 416/216, 217, 193 A, 219 R, 222, 248

(56) References Cited

U.S. PATENT DOCUMENTS 3,826,592 A * 7/1974 Raboin ..... 416/222
4,702,673 A * 10/1987 Hansen et al. ..... 416/215
4,781,532 A * 11/1988 Novacek et al. ..... 416/222
5,302,085 A * 4/1994 Dietz et al. ..... 416/220 R
5,474,423 A 12/1995 Seeley et al. ..... 416/222
5,494,408 A 2/1996 Seeley et al. ..... 416/222
5,509,784 A * 4/1996 Caruso et al. ..... 416/222
6,065,938 A * 5/2000 Bartsch ..... 416/219 R

* cited by examiner

*Primary Examiner*—Edward K. Look
*Assistant Examiner*—Richard A. Edgar
(74) *Attorney, Agent, or Firm*—Nixon & Vanderhye P.C.

(57) ABSTRACT

A turbine closure bucket adapted to complete assembly of a row of tangential entry buckets on a rotor wheel includes an airfoil portion and a mounting portion for mounting the bucket to a turbine wheel. The mounting portion has front and back faces, with weight reduction cavities formed internally in the front and back faces. Externally, the front and back faces of the closure bucket are substantially identical to front and back faces of adjacent buckets in the row.

9 Claims, 4 Drawing Sheets

LOW WINDAGE LOSS, LIGHT WEIGHT CLOSURE BUCKET DESIGN AND RELATED METHOD

This invention relates to turbine rotors and specifically to a new bucket design for the last or "closure" bucket assembled in a row of tangential entry type buckets on a turbine rotor wheel.

BACKGROUND OF THE INVENTION

Typically, turbine buckets, or blades, are assembled onto a rotor wheel either individually in axial directions, or tangentially through an opening to a circumferential dovetail. More specifically, tangential entry buckets each have dovetail hooks formed at its base. The buckets are assembled by inserting them, one at a time, axially into an opening at a tangent to the wheel surface so that the bucket dovetail hooks are aligned with the dovetail on the wheel, and then sliding the buckets circumferentially about the wheel along the dovetail, until all but one bucket has been assembled. The final or closure bucket is then inserted axially into the opening and secured to adjacent already in-place buckets.

In general, the purpose of the closure bucket is to complete the assembly of a row of tangential entry buckets on the rotor wheel, and, thus, it is the last bucket mounted on the wheel. Since the closure bucket cannot be attached directly to the rotor wheel dovetail like the remaining buckets, there is no need for the dovetail hooks found on all of the other buckets in the row.

Centrifugal stresses in the bucket/wheel dovetail are greatest near the closure bucket, and therefore, it is desirable to minimize the weight of the closure bucket. Current steam turbine closure buckets are designed such that the unnecessary interior hook elements are substantially removed, but material is added for strength. On the other hand, the overall weight is reduced by: 1) externally, removing material from the sides of the dovetail hooks; 2) removing material from the closure bucket sealing platform; and 3) removing material by forming cutouts on the front and back faces of the dovetail hooks. Material removal from these areas, however, increases performance losses. Specifically, this approach results in a discontinuity in the otherwise circumferentially continuous external dovetail hook surfaces when the entire row of buckets is assembled on the rotor wheel. This surface discontinuity contributes to performance losses first by windage heating of the steam flowing near the bucket dovetail, and second by allowing increased leakage flow through the stationary seal.

BRIEF SUMMARY OF THE INVENTION

This invention provides a steam turbine closure bucket that maintains the external shape of the neighboring buckets, thereby minimizing windage losses, while maintaining sealing surfaces on the bucket dovetail. In accordance with an exemplary embodiment of the invention, the weight of the closure bucket is reduced by removing pockets of material internally, from the front and back faces of the dovetail hooks. This removal of material creates internal cavities that do not alter the external shape of the bucket. The cavity geometry has been designed to remove the maximum amount of material while maintaining sufficient strength for assembly and operation.

In its broader aspects, therefore, the invention provides a turbine closure bucket adapted to complete assembly of a row of tangential entry buckets on a rotor wheel comprising an airfoil portion and a mounting portion for mounting the bucket to a turbine wheel, the mounting portion having front and back faces, and wherein weight reduction cavities are formed internally in the front and back faces of the mounting portion, but wherein the front and back faces of the closure bucket are substantially identical to front and back faces of adjacent buckets in the row.

In another aspect, the invention relates to a turbine closure bucket adapted to complete assembly of a row of tangential entry buckets on a rotor wheel comprising a blade portion and a dovetail portion for mounting the bucket to a turbine wheel, the dovetail portion having front and back faces and a sealing platform, and wherein weight reduction cavities are formed internally in the front and back faces of the dovetail portion, but wherein the front and back faces of the closure bucket are substantially identical to front and back faces of adjacent buckets in the row.

In still another aspect, the invention relates to a turbine rotor wheel having a dovetail formed about its periphery, with an axial opening therein, the rotor wheel having a plurality of turbine buckets received on the dovetail, each bucket having front and back faces; and a closure bucket that is received in the opening, the closure bucket having external front and back faces substantially identical to corresponding front and back faces of the plurality of buckets.

DETAILED DESCRIPTION OF THE INVENTION

Figure 1:
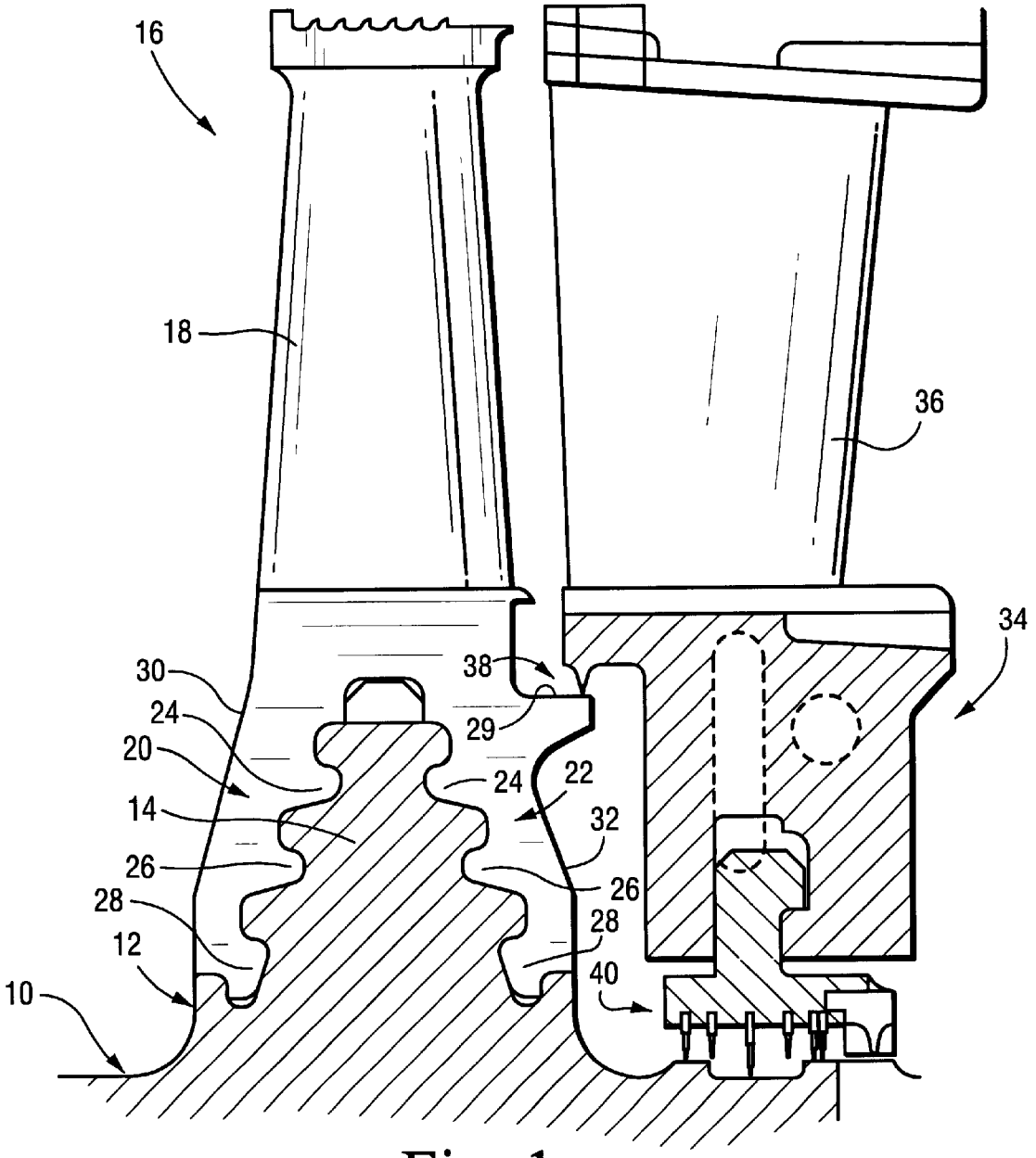
Fig. 1 (PRIOR ART)
FIG. 1 is a partial elevation, partly sectioned, of a conventional turbine rotor, illustrating a bucket mounted on a rotor wheel and an adjacent diaphragm.
Figure 3:
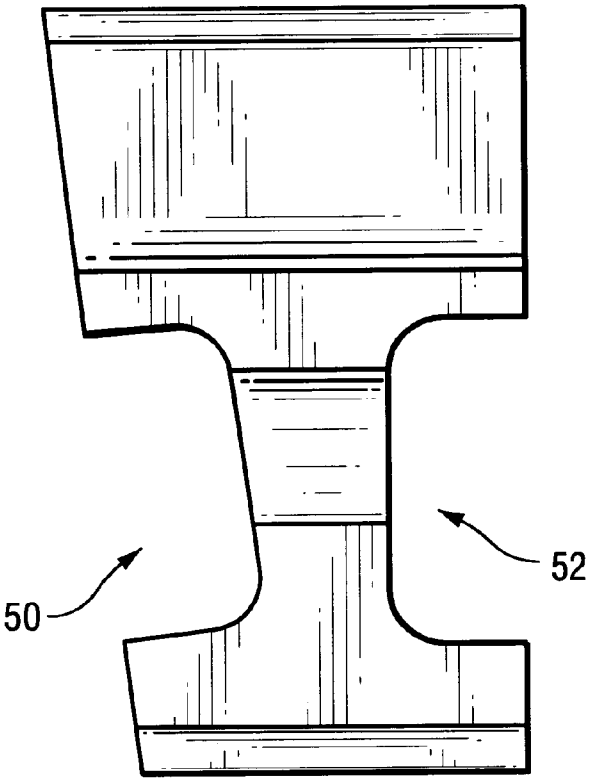
Fig. 3 (PRIOR ART)
FIG. 3 is an end view of the closure bucket shown in FIG. 2.
Figure 2:
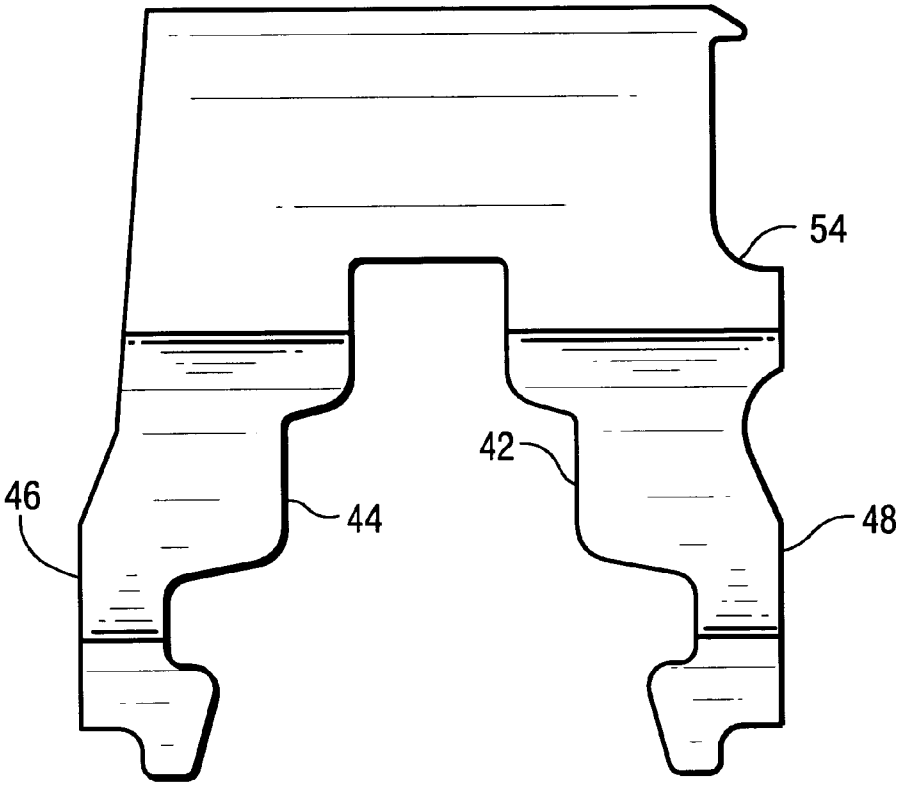
Fig. 2 (PRIOR ART)
FIG. 2 is a partial elevation of a conventional closure bucket.

Referring now to FIGS. 1–3, particularly to FIG. 1, a portion of a rotor 10 is shown, including a rotor wheel 12 provided with a male dovetail 14 that extends circumferentially about substantially the entirety of the periphery of the wheel, save a single axial opening or break in the dovetail that permits assembly of the plurality of buckets, one of which is shown at 16.

Each bucket includes a blade or airfoil portion 18 and a pair of mating dovetail hooks 20, 22 including internal pairs of hook elements 24, 26, 28 that enable the bucket 16 to be assembled onto the wheel 12 at the single opening about the circumference of the dovetail 14.

Outside surfaces of the dovetail hooks 20, 22 have front and rear faces 30, 32 that are upstream and downstream, respectively, in the direction of flow. A fixed diaphragm 34, including a row of fixed vanes 36, is located immediately adjacent the row of buckets 16, with conventional platform and labyrinth seals 38, 40, respectively, between the rotor and the diaphragm. During assembly, the buckets 16 are inserted, axially, into the circumferential opening in the dovetail 14, and then slid along and around the dovetail 14, this assembly procedure being followed for all of the buckets 16, until the only space remaining is that at the opening, where the closure bucket is inserted.

FIGS. 2 and 3 illustrate a conventional closure bucket, evidencing the prior methodology for reducing the weight of the closure bucket. Note initially that internal hook elements have been removed but material added, for example, in areas 42, 44 for strength. Weight reduction is achieved, however, by removal of material in three areas. First, material has been removed externally from the front and rear faces 46, 48. Second, notches or cut-outs 50, 52 have been formed in the sides of the dovetail hook region as best seen in FIG. 3. Third, the seal platform 54 has been axially shortened as compared to platform 29 in FIG. 1.

Figure 5:
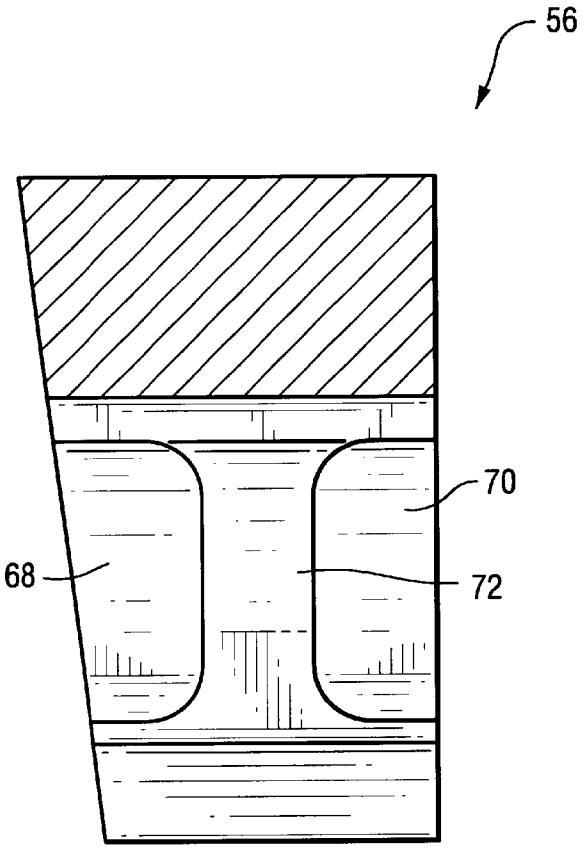
FIG. 5 is a section taken along the line 5—5 of FIG. 4.
Figure 4:
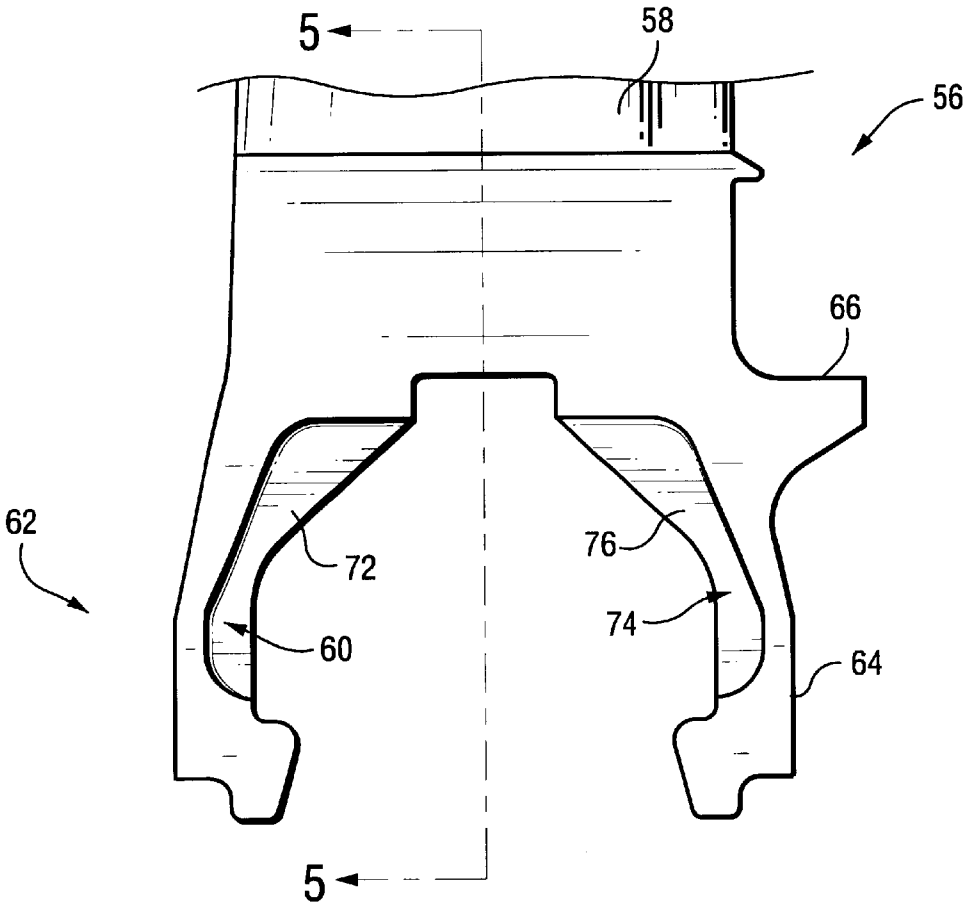
FIG. 4 is a partial elevation of a closure bucket dovetail hook region in accordance with this invention.
Figure 6:
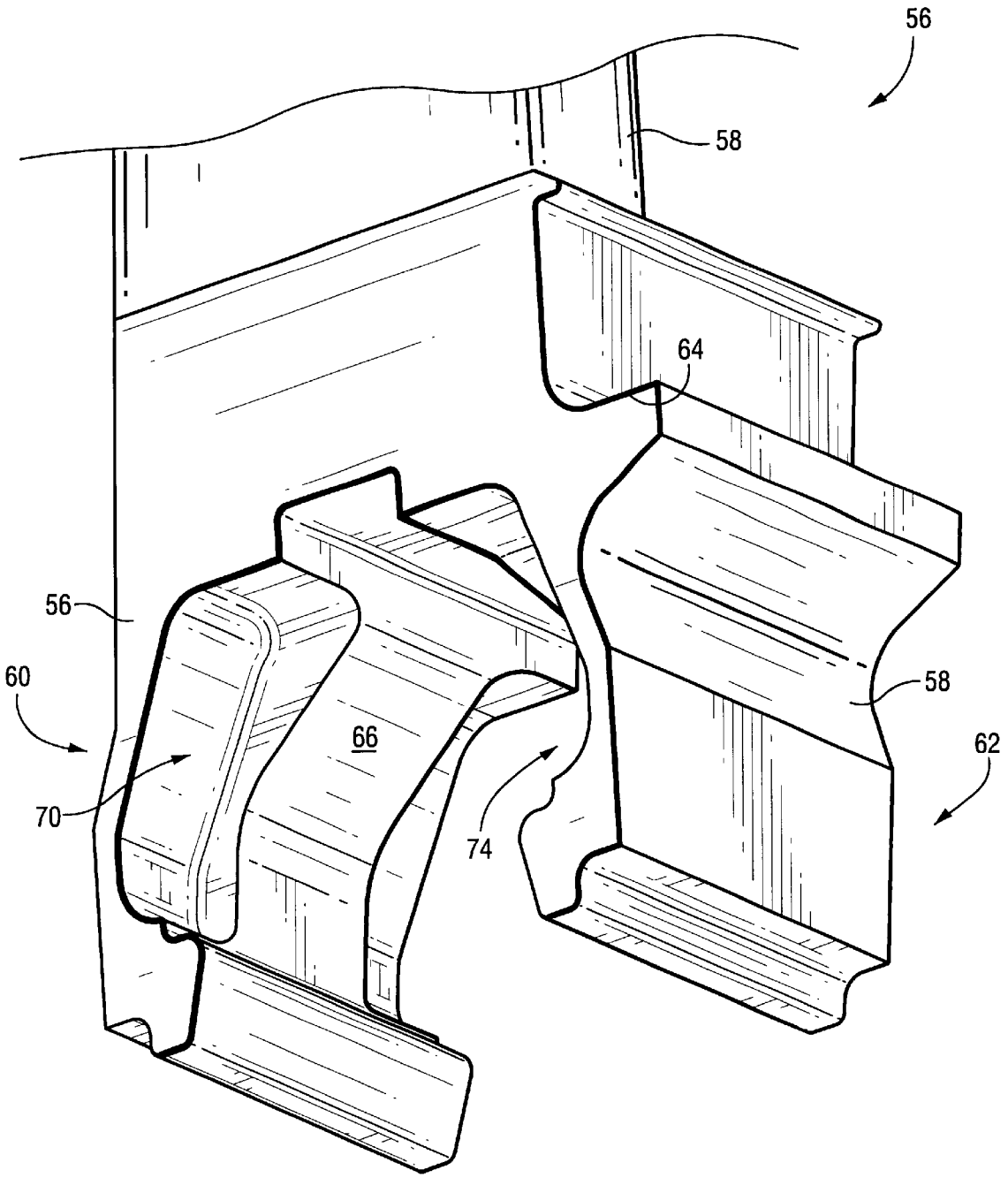
FIG. 6 is a perspective view of the dovetail hook region of the closure bucket in accordance with the invention.

Turning now to FIGS. 4–6, the present invention provides a closure bucket 56 that includes an airfoil portion 58 and a mounting portion 60, and with no internal dovetail hook elements. At the same time, however, the external shape of the closure bucket is substantially identical to the adjacent buckets in the row. In other words, the front and back faces 62, 64, and the sealing platform 66 are substantially identical to the front and rear faces 30, 32 and sealing platform shown in the typical tangential entry bucket 16 shown in FIG. 1. This uniformity of the external surfaces provides uniform flow of steam near the bucket dovetail without the windage loss experienced with prior designs. Here, material is removed internally, behind the front and back faces 62, 64. The material removed from behind one face forms cavities 68, 70 that lie on either side of a radially oriented rib 72, and similar cavities (one shown at 74) on either side of an opposed radial rib 76 from the opposite face. This arrangement removes the maximum amount of material while maintaining sufficient strength to drive the closure bucket at assembly and during operation.

This new configuration also reduces the size of the leakage path for flow through the stationary seal at the closure bucket, by retaining the full sealing platform 66.

This approach can be employed with many dovetail configurations, and it will be appreciated that the cavity geometry may be changed for each application, depending upon such variables as internal and external dovetail shapes, the number of buckets in a row, etc. It has also been determined that the weight reduction technique in accordance with this invention produces closure buckets that weigh within 5% of the existing closure buckets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine closure bucket adapted to complete assembly of a row of tangential entry buckets on a rotor wheel comprising an airfoil portion and a mounting portion for mounting the bucket to a turbine wheel, said mounting portion having front and back faces, and wherein weight reduction cavities are formed internally in the front and back faces of the mounting portion, but wherein said front and back faces of the closure bucket are substantially identical to front and back faces of adjacent buckets in the row.

2. The turbine closure bucket of claim 1 wherein a pair of said cavities are provided internally of each of said front and back faces.

3. The turbine closure bucket of claim 1 including a sealing platform adapted for engagement with an adjacent diaphragm seal.

4. The turbine closure bucket of claim 1 wherein, internally, said mounting portion is devoid of any dovetail hook elements.

5. A turbine closure bucket adapted to complete assembly of a row of tangential entry buckets on a rotor wheel comprising an airfoil portion and a mounting portion for mounting the bucket to a turbine wheel, said mounting portion having front and back faces; a pair of weight reduction cavities formed internally in each of the front and back faces of the mounting portion, but wherein said front and back faces of the closure bucket are substantially identical to front and back faces of adjacent buckets in the row; and wherein each pair of said weight reduction cavities is separated by a radially oriented rib.

6. A turbine closure bucket for completing assembly of a row of tangential entry buckets on a rotor wheel, said bucket having a pair of sides and front and rear faces, said front and rear faces each having a pair of internal cavities separated by a substantially radially extending rib.

7. A turbine rotor wheel having a dovetail formed about its periphery, with an axial opening therein, said rotor wheel having a plurality of turbine buckets received on said dovetail, each bucket having front and back faces; and a closure bucket that is received in said opening, said closure bucket having external front and back faces substantially identical to corresponding front and back faces of said plurality of buckets; and a pair of cavities provided internally of each of said front and back faces.

8. The turbine rotor wheel of claim 7 wherein said plurality of buckets and said closure bucket have substantially identical sealing platforms.

9. A turbine rotor wheel having a dovetail formed about its periphery, with an axial opening therein, said rotor wheel having a plurality of turbine buckets received on said dovetail, each bucket having front and back faces; and a closure bucket received in said opening, said closure bucket having external front and back faces substantially identical to corresponding front and back faces of said plurality of buckets; and a pair of cavities provided internally of each of said front and back faces; and wherein each pair of cavities is separated by a radially oriented rib.

* * * * *